US005294123A

United States Patent [19]

Black

[11] Patent Number: 5,294,123

[45] Date of Patent: Mar. 15, 1994

[54] PORTABLE GOLF GAME

[76] Inventor: Brendan C. Black, 11502 Newport Mill Rd., Silver Spring, Md. 20902

[21] Appl. No.: 959,375

[22] Filed: Oct. 13, 1992

Related U.S. Application Data

[63] Continuation of Ser. No. 719,496, Jun. 24, 1991, Pat. No. 5,154,426.

[51] Int. Cl.[5] ..... A63B 67/02

[52] U.S. Cl. ..... 273/176 E; 273/187.1; 273/176 B; 273/177 A; 206/315.9

[58] Field of Search ..... 273/177 R, 178 R, 187.1, 273/176 R, 176 E, 176 F, 176 FA, 176 FB, 176 G, 176 H, 177 A

[56] References Cited

U.S. PATENT DOCUMENTS

| | | | |
|---|---|---|---|
| 1,783,089 | 11/1930 | Hokin | 273/177 R |
| 3,342,494 | 9/1967 | Talley | 273/187.1 X |
| 3,700,243 | 10/1972 | Kenney | 273/178 R |
| 3,837,654 | 9/1974 | Fox et al. | 273/178 R |
| 5,154,426 | 10/1992 | Black | 273/184 A |

*Primary Examiner*—George J. Marlo

*Attorney, Agent, or Firm*—Beveridge, DeGrandi, Weilacher & Young

[57] ABSTRACT

A portable golf game includes a house-like housing with a hinged roof and internal supports for holding golf balls. The housing also holds all pieces of the game for convenient storage and transportation. In play, golf balls are putted through the housing via a ball entrance opening, a guide inside the housing, and a ball exit opening. To signify the movement of a ball through the housing, a lever causes the ejection of another golf ball from the housing. A stationary ball deflector is mountable near the ball entrance opening, on either side thereof as selected by the player, for deflecting a ball struck thereagainst into the ball entrance opening. Thin flat tee markers have markings which correspond to distinguishing markings on each of the player's golf balls. A crease apron near the ball entrance opening has a tongue extending through the ball entrance opening. Boundary lines divide the crease apron into zones, and the crease apron has ball-spotting makings which designate the spots where balls should be placed after they come to rest in the respective zones.

6 Claims, 3 Drawing Sheets

FIG_2
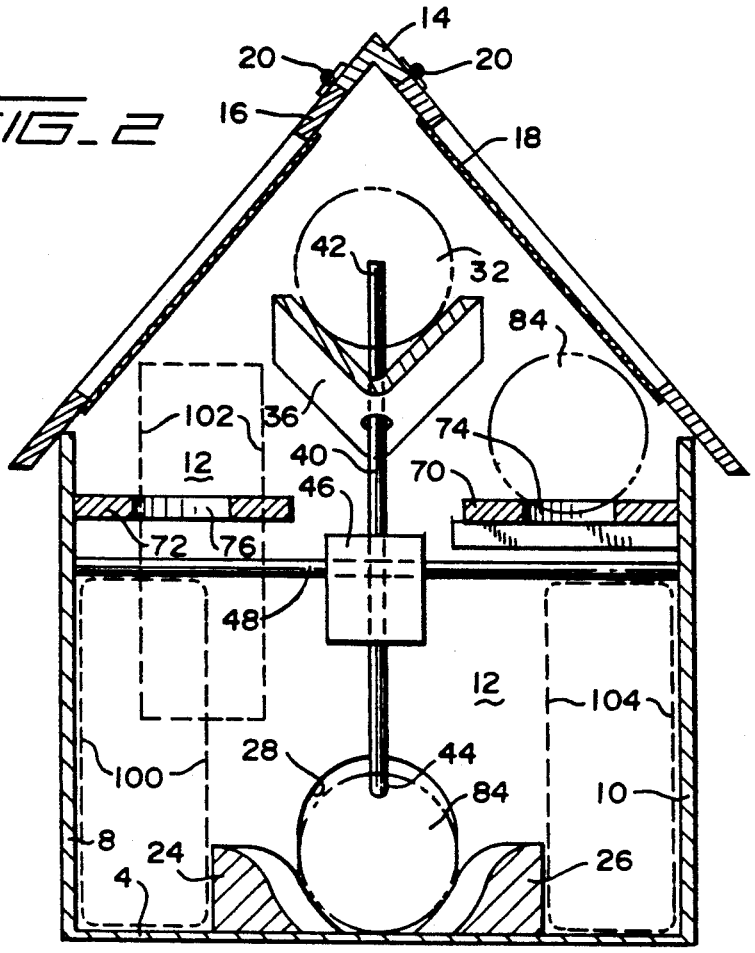
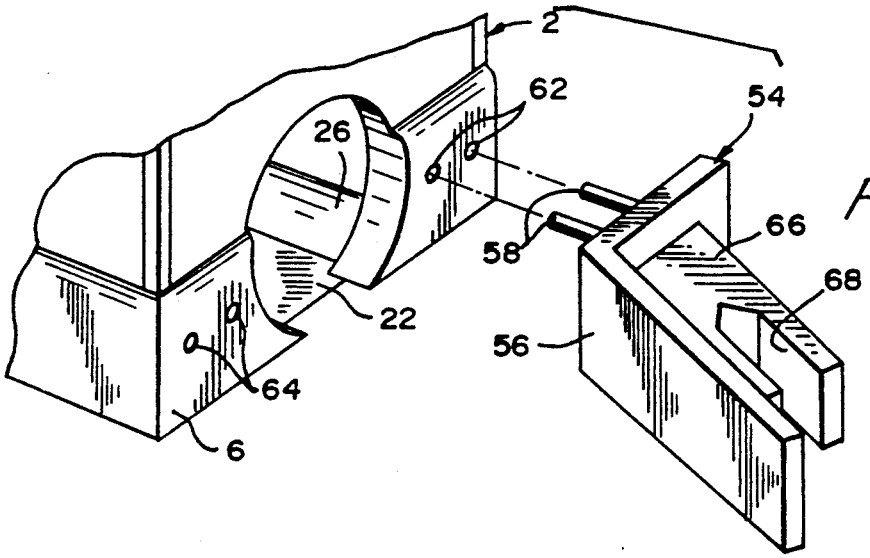
FIG_3

PORTABLE GOLF GAME

This is a continuation of U.S. Pat. application Ser. No. 07/719,496 filed Jun. 24, 1991, now U.S. Pat. No. 5,154,426.

BACKGROUND OF THE INVENTION

This invention relates to a portable golf game which is compact, versatile, attractive arid entertaining.

The game of golf is immensely popular, both as a participatory sport and as a spectator sport. However, it is relatively expensive and time-consuming; and, it usually cannot be done spontaneously without making advance arrangements, especially on weekends when golf courses are extremely crowded.

Miniature golf courses are also popular but they, too, require the participants to travel to the course and to pay for its use. Simulated golf games have been devised for use in or around the home, but they have never achieved widespread popularity. An example of such a device is described in U.S. Pat. No. 2,974,958.

It is an object of this invention to provide a new portable apparatus for playing golf in the home, at the office, in a college dormitory, or at any other convenient location. The apparatus is attractive, and its features make it compact, portable, interesting and, most importantly, enjoyable to use. Special provisions are made to facilitate storage of the game's components, and a mechanical ball ejector is provided to add to the action and provide for greater enjoyment by all participants.

SUMMARY OF THE INVENTION

In one respect, the present invention involves a game which has a portable golf housing with a hinged lid and internal ball-supporting means for storing golf balls in fixed apart positions. A ball entrance opening is provided in a lower portion of the front wall of the housing, and a ball exit opening is provided in the rear wall of the housing. Within the housing, guide means are provided for guiding a ball from the ball entrance opening to the ball exit opening.

In another respect, the invention involves a portable golf device which has a passage through which a first golf ball can be putted, means for supporting a second golf ball in the device, and means for ejecting the second golf ball from the device in response to movement of the first ball through the passage. Preferably, the second golf ball is ejected in a direction which is opposite to the direction of movement of the first ball through the passage, the second golf ball is ejected through a ball outlet opening provided with a normally closed door, and the ejecting means includes a lever with a trigger portion projecting into the passage and a ball-engaging portion contacting the second golf ball. When the first golf ball engages the trigger portion, the ball-engaging portion moves relative to the ball to produce the ball ejection action.

In another respect, the invention involves portable golf apparatus in which a ball deflector is placed adjacent to a ball entrance opening and a wall. The deflector is movable from a first position where it is on one side of the ball entrance opening to a second position where it is on the other side of the ball entrance opening.

Still another aspect of the invention involves the relationship between player's balls and tee markers. In this regard, the game has a plurality of balls with distinguishing markings thereon for identifying the balls of the individual players, and the tee markers are arranged so that at least two tee markers have distinguishing markings corresponding to the distinguishing markings on each one of the player's balls.

A further feature of the invention concerns the use of zone designating means in the vicinity of a ball entrance opening formed in the wall of the device. The zone designating means is a horizontal member with boundary lines identifying the zone boundaries, and fixed ball-spotting marks for indicating where a ball is to be placed after it comes to rest in a respective zone. Preferably, the horizontal member has a tongue which extends through the ball entrance opening.

The disclosed apparatus includes all of the above-mentioned features. Although the apparatus may take many forms, the best mode contemplated for practicing the invention is described below and is illustrated in the accompanying drawings.

BRIEF DESCRIPTION OF THE DRAWINGS

FIG. 2 is a transverse sectional view of the apparatus as seen along the line 2—2 in FIG. 1.

FIG. 3 is a perspective view showing the ball deflector feature of the apparatus.

DETAILED DESCRIPTION

Figure 1:
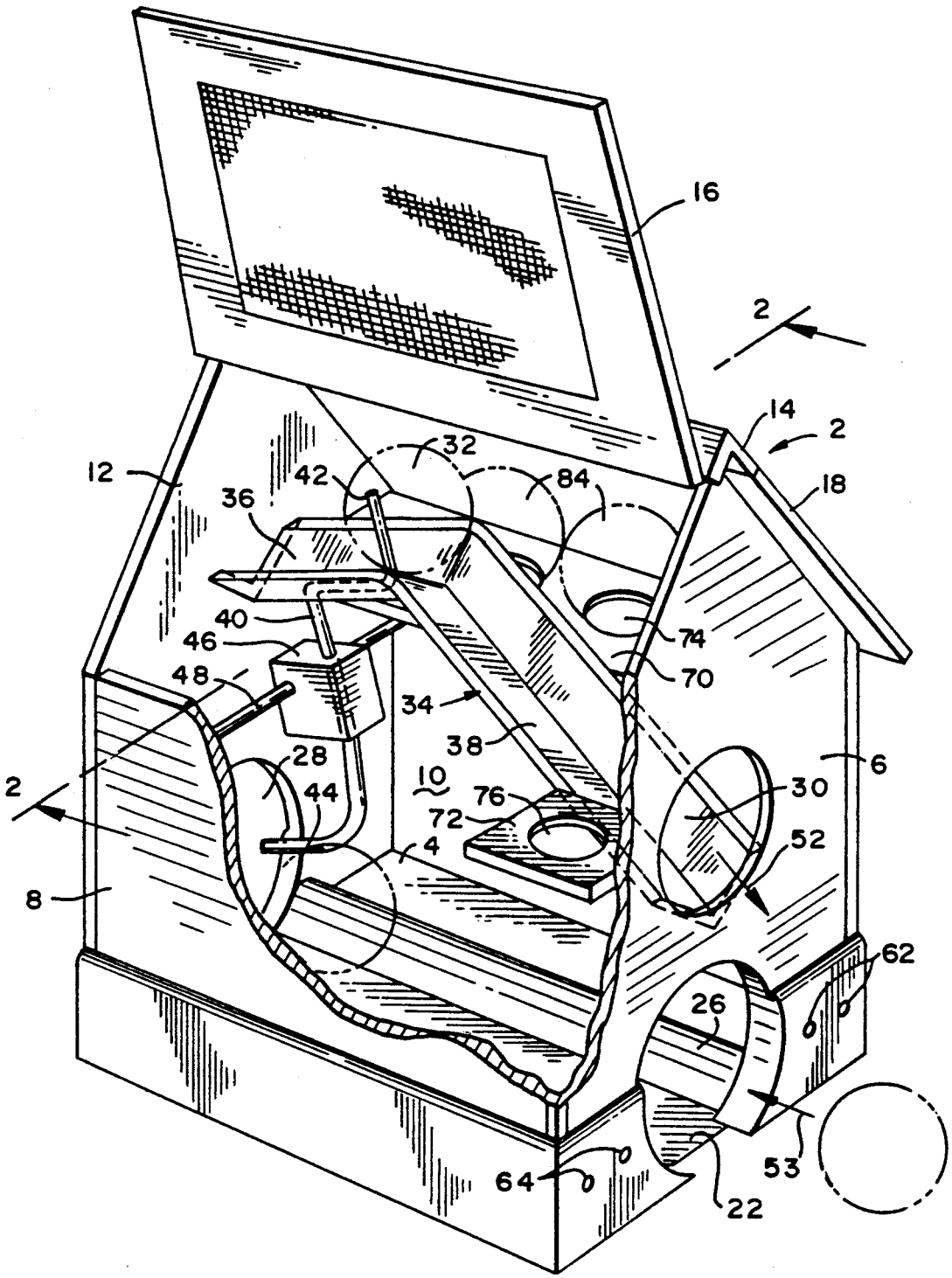
FIG. 1 is a partially broken perspective view of a preferred device constructed according to the invention.

The best mode contemplated for practicing the invention is shown in the accompanying drawings wherein it will be seen that there is "golf housing," i.e. a portable house-shaped body or housing 2 which is used for playing the game and for storing its principal components. The housing has a bottom wall 4, front wall 6, side walls 8 and 10, rear wall 12, ridge piece 14, and two roof members 16, 18 which are connected to the ridge piece by hinges 20 as shown in FIG. 2.

The front wall 6 has a ball entrance opening 22 into which balls may be putted in the course of play. Inside the housing, there are two rails 24, 26 which guide a ball from the opening 22 to a ball exit opening 28 formed in the rear wall 12 of the housing. The rails 24 and 26 converge toward each other so that, as can be seen in FIG. 2, the ball will be precisely centered when it arrives at the trigger portion 44 described below in this specification. Due to this convergence, the width of the ball exit opening 28 is about equal to the ball diameter, and it is significantly narrower than the ball entrance opening.

The players are provided with golf clubs, normally putters, which are used to putt the balls into the ball entrance opening 22 and through the housing.

The front wall 6 of the golf house 2 also has an elevated ball outlet opening 30 through which a second golf ball 32, referred to herein as the "house ball," is ejected when a player successfully putts his ball into the ball entrance 22 opening and through the housing.

The mechanism for ejecting the house ball includes a track 34 which is V-shaped in transverse cross section. The track 34 has a forwardly ascending rear section 36 and a forwardly descending front section 38 which delivers a ball to the ball outlet opening 30.

The house ball is initially placed on the rear section 36 of the track where it is stationary and its rearward movement is prevented by the upper end 42 of a lever 40.

The lever 40 has a lower trigger portion 44 which projects into the passage defined by the guide rails 24, 26 through which the golf balls move during play. The lever 40 is mounted on a block 46 which is pivotally supported on a rod 48 which extends transversely between the side walls 8 and 10 of the housing.

When a player's ball moves through the housing from the ball entrance opening 22 to the ball, exit opening 28, it contacts the lower trigger portion 44 of the lever 40 to move the lever slightly in a clockwise direction as viewed in FIG. 1, thus causing the upper portion 42 of the lever 40 to advance the house ball 32 from the ascending portion 36 to the descending portion 38 of the track 34. The house ball 32 then travels gravitationally along the track, down to and through the ball outlet opening 30.

Figure 4:
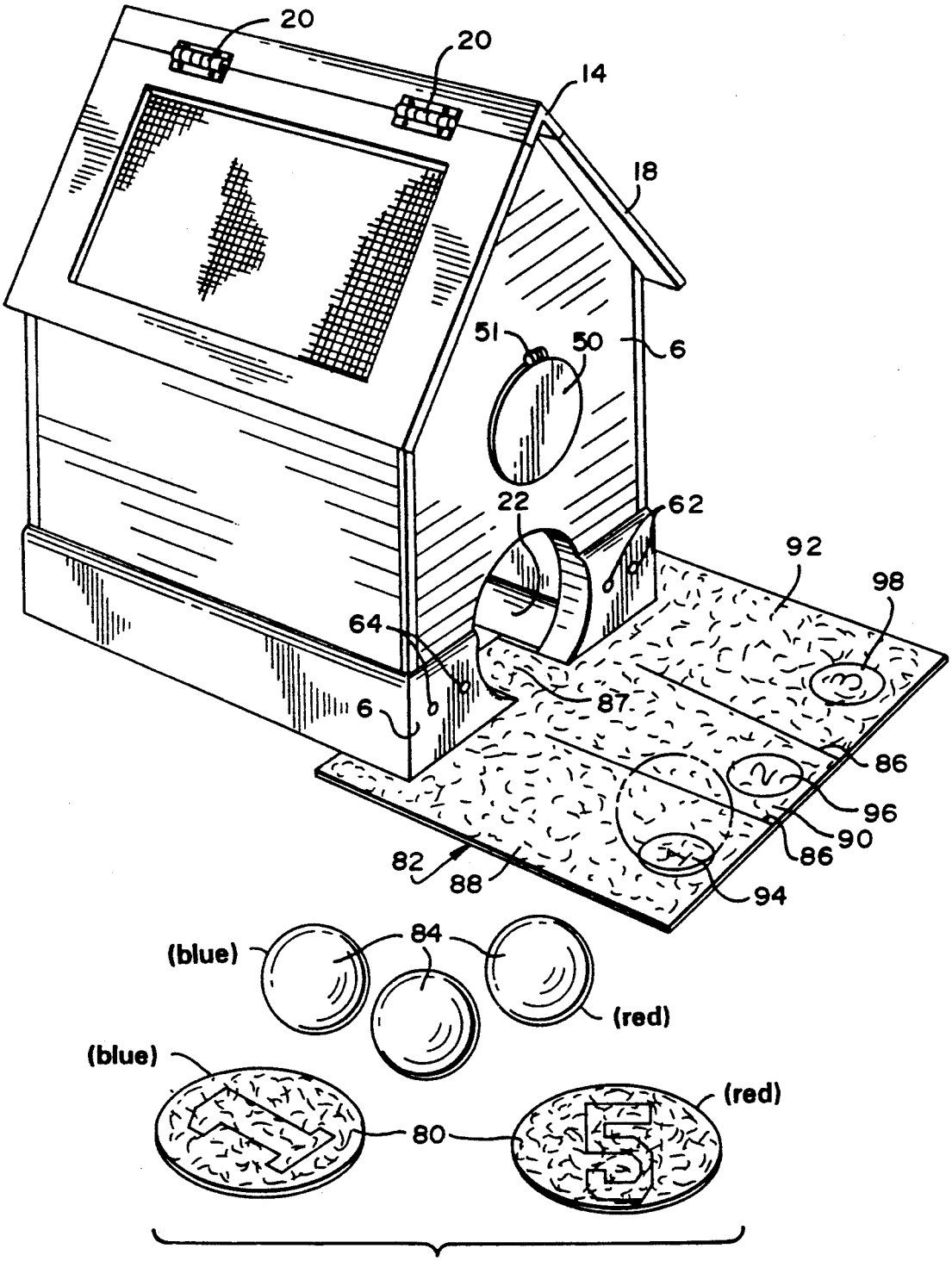
FIG. 4 is a perspective view of the apparatus including the crease apron, balls and tee markers.

The house ball outlet 30 is normally closed by a door which has been omitted from, FIG. 1 for illustrative purposes. As shown in FIG. 4, this door is supported on an eyeglasses-type hinge 51 provided with a stop which prevents the door from swinging inwardly and also provides an audible tapping sound when the door 50 closes. It is normally closed but, When struck by tile house ball 32, it will move to an open position to permit the house ball 32 to pass through the opening 30 and into the course. The house ball 32 is ejected in the direction of arrow 52, which is opposite to the direction the players' balls move through the housing as represented by the arrow 53. When the door closes gravitationally, the hinge 51 makes a tapping sound as the door comes to rest, thus providing an audible signal to enhance the game.

The tactics of play are considerably enhanced by utilization of a deflector 54 shown in FIG. 3. The deflector, also called a "handicap angler," has a vertical ball deflecting surface 56 which is oriented 45 degrees relative to the surface of the front wall 6 of the housing 2. The deflector is movable from a position where it is on the right side of the ball entrance opening 22 to a position where it is on the left side of the opening 22. The deflector is connected to the housing by a pair of pegs 58 which are insertable into mating pairs of holes 62, 64 drilled in the front wall of the housing. Each pair of holes serves as a deflector mounting means for detachably supporting the deflector 54. Thus, during the course of play, a player may mount the deflector 54 on either the left or right side of the ball entrance opening 22, and putt his ball against the surface 56 of the deflector which will deflect a properly struck ball into the ball entrance opening 22.

The deflector is reinforced by a member 66 which is notched at 68 to facilitate its storage inside the housing 2. To store the deflector, it is oriented so the open end of the notch 68 faces down, and it is slipped down over the rod 48 so the rod engages the closed inner end of the notch.

The interior of the housing is provided with horizontal shelves 70 and 72 with circular holes 74 and 76 for receiving the golf balls for storage and transportation purposes. The player's balls 84 are stored and carried on the member 70 in fixed spaced-apart positions, and the house ball is stored on the member 72. The shelf 70 is removably supported on a horizontal support 71 on the rear wall 12 of the housing 2, and a corresponding support (not shown) on the interior surface of the front wall.

The balls 84 are marked to distinguish them from each other. Markings such as colors, icons, or alphanumeric characters may be used.

The tee markers 80 are used to identify the tees for the individual "holes," i.e. to mark the positions where the balls are placed at the beginning of each hole of play. The tees 80 are preferably made of thin flat pieces of colored felt. The balls 84 are preferably marked by distinguishing colors, and at least two tees 80 are provided of a color which corresponds to the identifying color of each ball 84.

To facilitate movement of a ball into the ball entrance opening 22, a crease apron 82 is provided. It is a thin, flat, horizontal piece of felt which has a tongue 87 extending into and through the ball entrance opening 22.

The crease apron 82 solves the problem which occurs when a ball 82 comes to rest closely adjacent to the front wall 6 of the housing 2 where it cannot be struck directly into the ball entrance opening 22. For this purpose, the crease apron has boundary lines 86 which identify the boundaries of three zones 88, 90, and 92. Fixed ball-spotting marks 94, 96, and 98 are located in each of these zones. During play, when a player's ball 84 comes to rest in one of the crease zones 88, 90, or 92, the rules of play permit the player to move the ball to the spot 94, 96, or 98 associated with the respective zone.

The interior of the housing 2 is easily accessible for storing and retrieving the game parts, simply by swinging the roof members 16 and 18 up to its raised position shown in FIG. 1. Ample spaces is provided in the housing for storing other components such as the deflector 54, a decorative pennant-like flag (not shown) which is mountable on the golf house 2, a scorepad (not shown), and the pieces shown in FIG. 4 including nine tee markers 80, and the crease apron 82. The crease apron 82 can be folded around the stack of tees and stored toward the front of the housing 2, in the area indicated by the broken line rectangle 100 in FIG. 2. The deflector 54 can be stored against the rear wall 12 in the area 102. The scorepad can stand vertically against the side wall 8, spaced rearwardly of the stack of tees and forwardly of the deflector 54. An enlarged crease apron used for tournament play can be folded and stored in the area 104 beneath the removable shelf 70. The tournament crease apron has a curved perimeter, and curved boundary markings.

When playing one version of the game with the apparatus of the invention, the tee markers 80 are previously positioned by mutual agreement of the players. To provide variety among the "holes," tees one and five are placed to provide the easiest holes. Tees two and six are less favorable, tees three and seven are more difficult, and tees four and eight are the most difficult.

In a variation of the tee-placement rule, each player takes two different tee markers 80 and places them wherever he desires. Markers can be placed behind furniture, behind other obstacles, or in another room to increase the difficulty of play.

The order of play is initially determined by putting the balls 84 toward a reference line such as the forward edge of the crease apron 82. The player whose ball is closest to the reference line without traveling onto the crease apron becomes the first player, the second closest is the second player, etc.

The first player spots his ball on the first tee marker, and he strikes the ball with his putter until it goes through the golf house 2 to eject the house ball 32. The other players follow in turn. Play then progresses to the second hole, third hole, etc., in sequence. Each hole commences at the respectively numbered tee 80, and it ends at the golf house 2 when the house ball 32 is ejected. Strokes are counted and recorded on a score pad.

Scoring is conventional, except that each player has "bonus holes" on those tees which have a color (or other identifying characteristic) corresponding to the color of his ball. A hole-in-one on a bonus hole entitles the player to skip the next hole. A player who completes a hole in two strokes (an "eagle") may remove two strokes from his total score in the game. The ninth hole is a bonus hole for all players in the respect that any player scoring a hole-in-one may deduct the strokes taken on his highest hole from his total score. No player may claim more than three bonuses in a nine hole game.

The deflector 54 may not be used more than five times during a game by any player and, when it is used, onehalf stroke is added to the player's score.

If the house ball 32 does not eject when a ball goes through the golf house 2, the player is given a second opportunity from a point which is a putter-length distance from the ball entrance opening 22. If this extra shot successfully ejects the house ball 32, the stroke is not counted. However, if the ball 32 is not ejected on this second opportunity, a stroke is charged against the player.

Persons familiar with the field of the invention will recognize that the structure and rules of the game may take many forms other that those shown and described in this specification. Therefore, it is emphasized that the invention, rather than being limited to the specific embodiment disclosed herein, encompasses many different devices which fall within the spirit of the following claims.

I claim:

1. Portable apparatus for playing a golf game, comprising, a housing having an access opening, a hinged lid on the housing for covering said access opening, ball-supporting means inside said housing for storing golf balls in fixed spaced-apart positions, said housing having an upstanding front wall with a ball entrance opening formed in a lower portion thereof for receiving a golf ball which is putted into said entrance opening, said housing having a rear wall provided with a ball exit opening, and guide means in said housing for guiding a ball from said ball entrance opening to said ball exit opening.

2. Apparatus according to claim 1 including deflector means adjacent to said ball entrance opening for deflecting a ball into said ball entrance opening, means for supporting said deflector means at a first user-selected position where it is on one side of said ball entrance opening and at a second user-selected position where it is on another side of said ball entrance opening.

3. Apparatus according to claim 2, wherein said housing has two deflector mounting means for detachably supporting said deflector means, said deflector mounting means being on opposite sides of said ball entrance opening.

4. Apparatus according to claim 1 further including a plurality of balls with distinguishing marks thereon for identifying the individual balls, tee markers for marking positions where the balls are to be positioned at the commencement of each hole of play, at least two of said tee markers being provided with distinguishing markings corresponding to the distinguishing markings on each one of said balls.

5. Apparatus according to claim 1 further including zone designating means for identifying horizontal areas adjacent to said ball entrance opening, said zone designating means including a horizontal member provided with boundary lines which identify a plurality of zones, said zone designating means including ball-spotting marks for indicating where a ball is to be placed after it comes to rest in a respective zone.

6. Apparatus according to claim 5 wherein the horizontal member has a tongue which extends through the ball entrance opening.

* * * * *